United States Patent [19]

Lancaster

[11] Patent Number: 4,747,254

[45] Date of Patent: May 31, 1988

[54] WEB THREADING DEVICE

[75] Inventor: Joseph R. Lancaster, Louisville, Ky.

[73] Assignee: Lantech, Inc., Louisville, Ky.

[21] Appl. No.: 228

[22] Filed: Jan. 2, 1987

[51] Int. Cl.[4] ..... B65B 11/04

[52] U.S. Cl. ..... 53/556; 53/587; 226/92

[58] Field of Search ..... 53/556, 587; 226/92; 242/47.03; 352/157

[56] References Cited

U.S. PATENT DOCUMENTS

| | | | |
|---|---|---|---|
| 4,079,877 | 3/1978 | McAnespie | 226/92 |
| 4,330,191 | 5/1982 | Rawlings | 226/92 X |
| 4,409,777 | 10/1983 | White | 53/587 |
| 4,480,801 | 11/1984 | Stone | 226/92 X |

*Primary Examiner*—John Sipos

*Attorney, Agent, or Firm*—Finnegan, Henderson, Farabow, Garrett & Dunner

[57] ABSTRACT

A device for threading the leading end of a web through a web path between a series of rollers in shafts includes a leader line for attachment to the leading end of the web and for drawing the web through the web path. There is also a leader path on one side of the series of rollers which is generally parallel to but beside the web path for supporting the leader line means and confining the lateral movement of the leader line means while permitting longitudinal movement of the leader line means and the leading end of the web in the direction generally parallel to but beside of the web path. The leader path includes pulleys mounted on the roller shafts which freely rotate relative to the respective rollers. The leader line includes a proximal end portion by which the leader line means is engaged and drawn, a distal end portion, and a loop intermediate the proximal and distal end portions for attachment of the leader line connected to a retractor to the web.

23 Claims, 4 Drawing Sheets

FIG 1
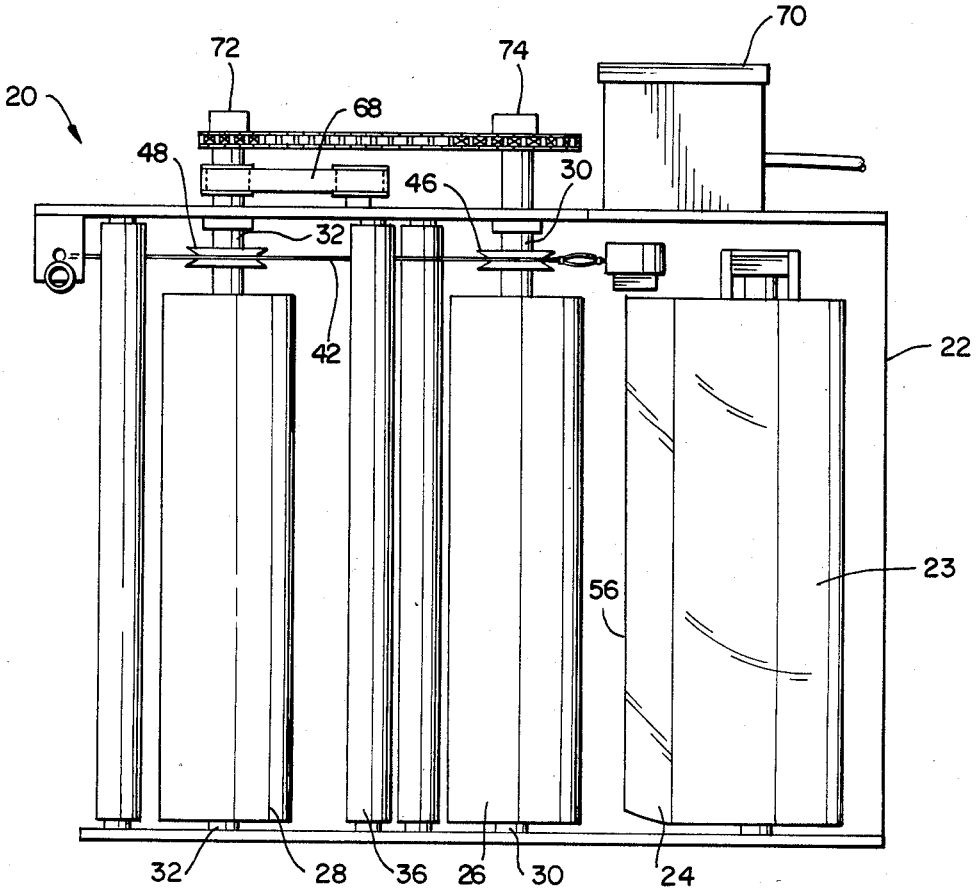
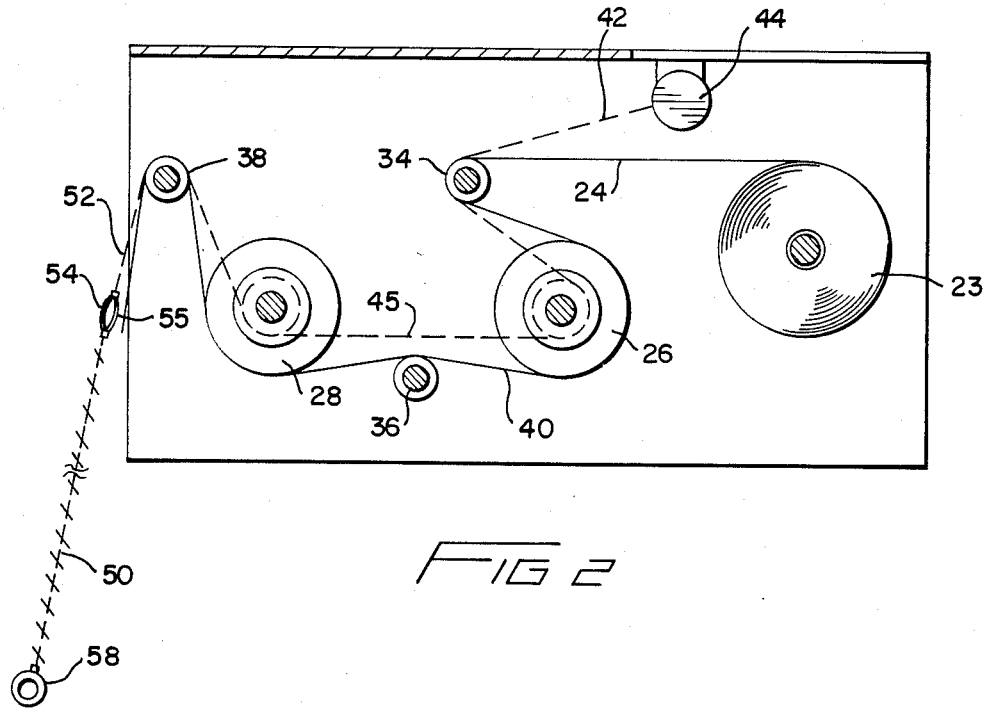
FIG 2

WEB THREADING DEVICE

BACKGROUND OF THE INVENTION

The present invention relates to a threading device and, more particularly, relates to a device for threading a web through a series of rollers in a stretch wrapping apparatus.

During the past two decades, considerable developments have been made in the field of wrapping a load with a stretched web of film. Most notably, the film web dispenser used in stretch wrapping operations has developed to the extent that it contains a series of rollers which defines a path through which the web passes so that it can be prestretched prior to being dispensed on the load. Such stretch wrapping apparatus is disclosed, by way of example, in U.S. Pat. Nos. 4,302,920 and 4,418,510 to Lancaster et al., and assigned to Lantech, Inc. which are incorporated herein by reference.

Such stretch wrapping apparatus performs admirably in accomplishing its intended goal of wrapping a load with a stretched web of film. However, the procedure of threading the film web through the series of rollers in the film web dispenser prior to operation of the stretch wrapping apparatus has been found to be time consuming and difficult. This is especially true now because of the development of film web dispensers having increased numbers of rollers and also because such rollers are often closely spaced and difficult to turn because of their effective interconnection for prestretching the film web prior to dispensing the film web on the load.

Accordingly, it is an object of the present invention to provide an arrangement for threading a web through a web path between a series of rollers while reducing the time and difficulty previously required for this task.

Additional objects and advantages of the invention will be set forth in the description which follows and in part will be obvious from the description or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a device for threading the leading end of a web through a web path between a series of rollers on shafts comprising: leader line means for attachment to the leading end of the web and for drawing the web through the web path; and leader path means on one side of the series of rollers and generally parallel to but beside the web path for supporting the leader line means and confining the lateral movement of the leader line means while permitting longitudinal movement of the leader line means and the leading end of the web in a direction generally parallel to but beside the web path.

BRIEF DESCRIPTION OF THE DRAWINGS

The accompanying drawings, which are incorporated in and constitute a part of the specification, illustrate a presently preferred embodiment of the invention and, together with a general description given above and the detailed description of the preferred embodiment given below, serve to explain the principles of the invention.

FIG. 1 is a side elevation view of a web threading device prior to threading, incorporating the teachings of the present invention;

FIG. 2 is a top schematic view showing web and leader paths of the embodiment illustrated in FIG. 1 after threading;

DESCRIPTION OF THE PREFERRED EMBODIMENT

Figure 3:
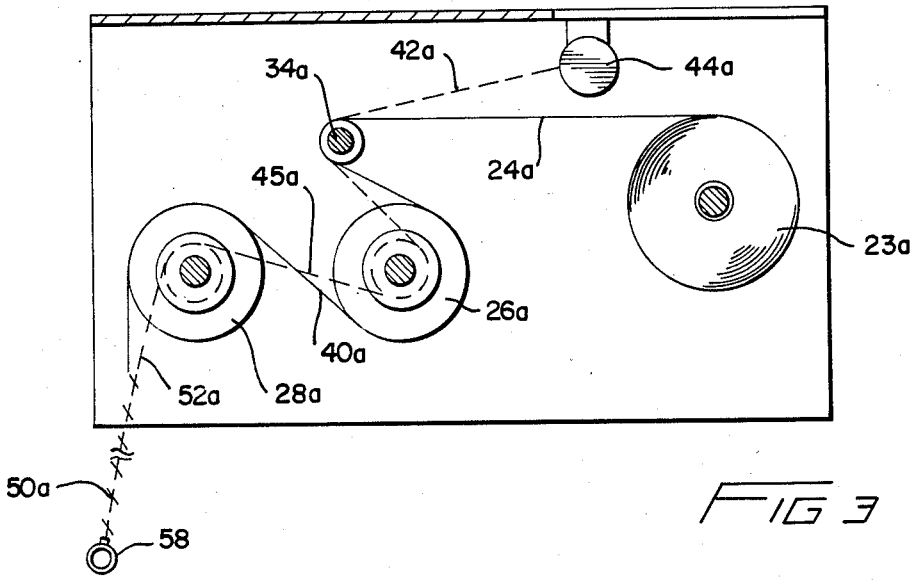
FIG. 3 is a schematic view showing the web and leader paths of a second embodiment of the present invention.

Reference will now be made in detail to the present preferred embodiment of the invention as illustrated in the accompanying drawings.

In accordance with the present invention there is provided a device for threading the leading end of a web through a web path between a series of rollers on shafts comprising: leader line means for attachment to the leading end of the web and for drawing the web through the web path; and leader path means on one side of the series of rollers and generally parallel to but beside the web path for supportinq the leader line means and confining the lateral movement of the leader line means while permitting longitudinal movement of the leader line means and the leading end of the web in a direction generally parallel to but beside of the web path.

As shown and embodied in FIG. 1, the device for threading the leading end of a web through a web path between a series of rollers on shafts includes a stretch wrapping device 20. Stretch wrapping device 20 includes a stretch wrapping dispenser frame 22 for rotatably supporting a roll 23 of film web 24, and a series of rollers on shafts including prestretch rollers 26 and 28 mounted on shafts 30 and 32 which pass through and rotate with prestretch rollers 26 and 28. As shown in FIG. 2, prestretch rollers 26 and 28, and other rollers 34, 36 and 38, which are also mounted in dispenser frame 22, serve to define a web path 40 for film web 24 between the series of rollers 34, 26, 36, 28, 38 from the first roller 34 in the series to the last roller 38 in the series along the solid line representing the film web 24.

In accordance with the present invention there is provided leader line means for attachment to the leading end of the web, and for drawing the web through the web path. As shown and embodied in FIGS. 1 and 2, the leader line means is a cord 42 made of twine or a similar flexible material which extends from a retracter 44 through a leader path 45 as shown in FIG. 2 by a broken line, which is generally parallel to the web path 40 shown by a solid line.

In accordance with the present invention, it is preferable that the leader path means includes at least one pulley mounted on the shaft of at least one respective roller and that the pulley is mounted to freely rotate relative to the respective roller. As shown and embodied in FIGS. 1 and 2, the leader path means includes pulleys 46 and 48 which are respectively mounted on shafts 30 and 32 of prestretch rollers 26 and 28, to freely rotate independent of those shafts and prestretch rollers 26 and 28. Similar freely rotating surfaces, such as collars (not shown) are preferably provided on the portions of rollers 34, 36 and 38 over which leader cord 42 passes. By allowing those collars and pulleys 46 and 48 to rotate independent of rollers 26, 28, 34, 36 and 38, leader cord 42 will not be driven or abraided during operation of the prestretch apparatus after the web has been threaded.

It is further preferable that at least one pulley includes an indented outer surface for confining the lateral movement of the leader line means. As shown and embodied in FIG. 1, both pulleys 46 and 48 have V-shaped surfaces which confine the lateral movement of leader cord 42.

It is seen that the lateral movement of leader cord 42 is confined in the plane of the drawing shown in FIG. 2 by the radial surfaces of pulleys 26 and 28 and the collars (not shown) on rollers 34, 36 and 38. Further, the lateral movement in the plane defined by the drawing in FIG. 1 is confined by the V-shape of pulleys 46 and 48. However, longitudinal movement of leader cord 42 is permitted by this arrangement.

In accordance with the present invention, the leader line means includes a proximal end portion by which the leader line means is engaged and drawn, a distal end portion, and means intermediate the proximal and distal end portions for said attachment of the leader line means to the web. It is preferable that the intermediate portion includes loop means for attachment to the web and that the loop means includes a segment of elastic material.

As shown in FIG. 2, the proximal end portion of leader cord 42 is the leading portion and is indicated by cross hatching. The distal portion is the trailing portion and is indicated by no cross hatching. The loop includes a loop 54 at the junction between the proximal and distal portions. Loop 54 preferably has a segment of elastic material 55 which is joined at each end to leader cord 42.

In accordance with the invention, it is preferable that the length of the distal portion is about at least as long as the length of the leader path means. As shown in FIG. 2, the length of the leader path means is at least as long as the length of leader path 45, which extends from the first roller 34 in the series to the last roller 38 in the series along the broken line representing the leader cord 42. Distal portion 52 is longer than the leader path 45 so that when leading edge 56 of the roll of film web 24 is attached to loop 54, leader cord 42 can be pulled through the leader path 45 along with the leading edge 56 of the film web 24 while remaining along the entire extent of leader path 45. As a result, leader cord 42 can be retracted into retractor 44 after the web has been threaded through web path 40 so that it is ready for the next threading operation without having to be threaded through the leader path 45. One example of a suitable retractor 44 is a tool balancer commonly used to suspend and balance tools.

Figure 5:
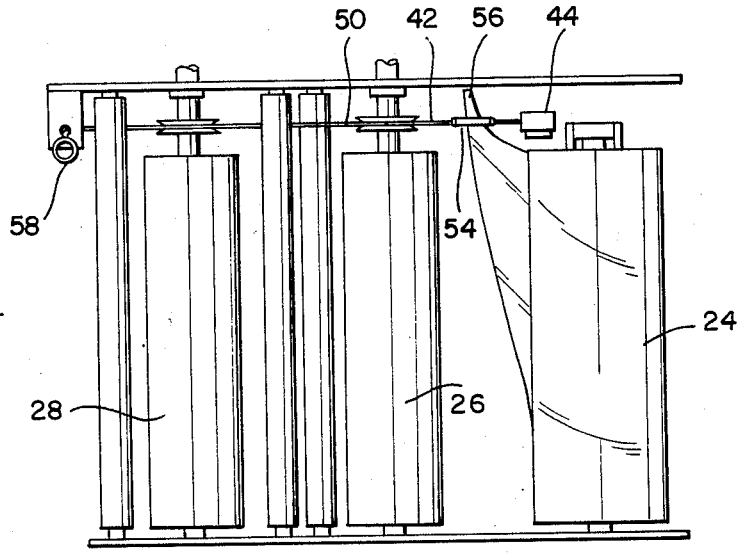
FIGS. 5–9 are side elevation views of the embodiment illustrated in FIG. 1 showing succeeding stages of the web threading operation.
Figure 6:
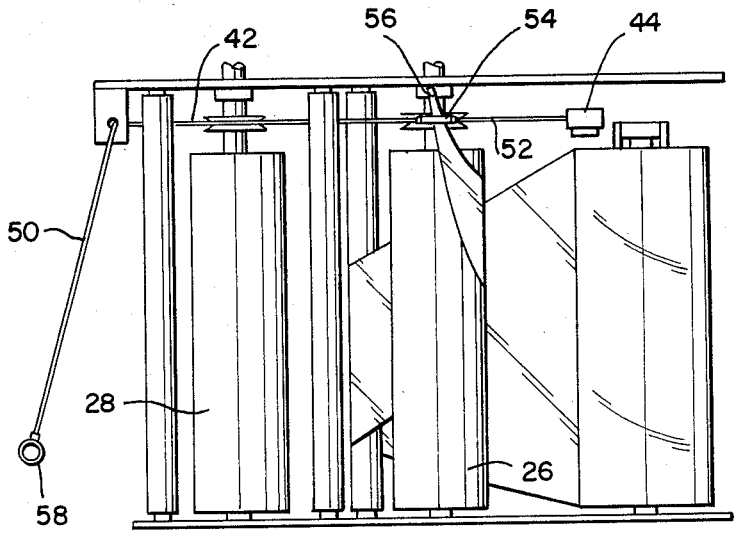
Figure 7:
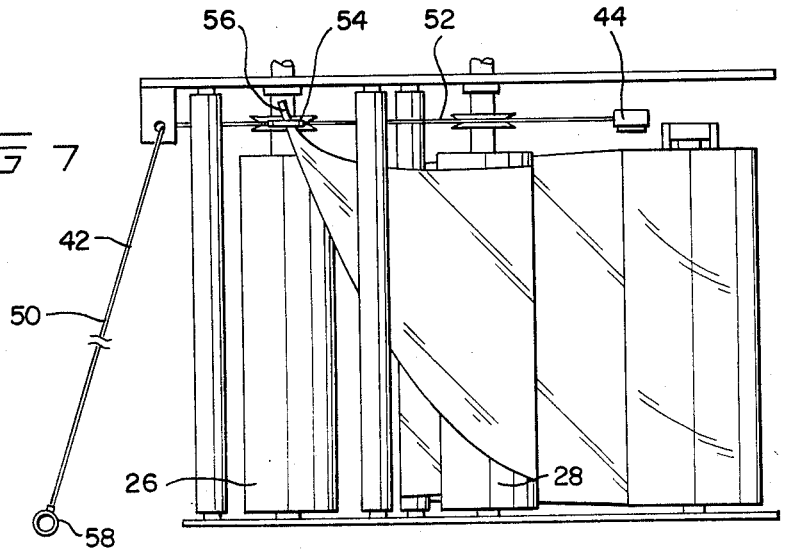
Figure 8:
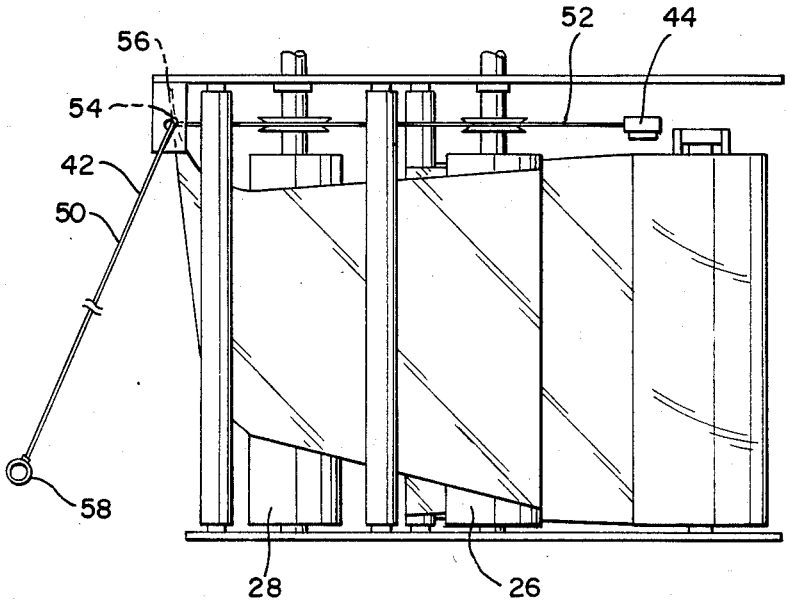

The operation of the web threading device of FIG. 1 at successive stages is illustrated in FIGS. 5–9. As shown in FIG. 5, the leading end 56 of the roll of film web 24 is inserted through loop 54 of leader cord 42. Proximal portion 50 of leader cord 52 extends through the leader path defined by pulleys 46 and 48 and the collars on the other rollers as described above. The distal portion of leader cord 42 is wound up inside retractor 44.

Figure 9:
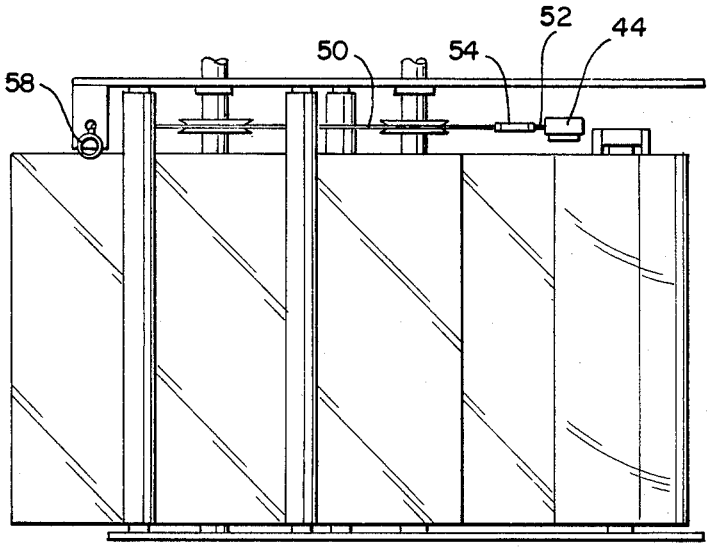

The leading end of proximal portion 50 includes a handle 58 which an operator can engage with his hand to pull and advance leader cord 42. As handle 58 is pulled and leader cord 42 advances to the position shown in FIG. 6, loop 54 draws leading end 56 of the web 24 along the leader path 45 while drawing the film web 24 through the web path 40. As handle 58 is pulled farther, leader cord 42 and the film web 24 is drawn completely through the system to the position in FIG. 8. At this point, the leading end 56 of film web 24 is detatched from loop 54 and the leader cord 42 is allowed to be retracted into retractor 44 so that it is ready for the next threading operation. This final position is shown in FIG. 9. The leading end 56 of the film web 24 is then attached to the load and the load is wrapped in the usual manner by rotating the load relative to the dispenser.

In accordance with the present invention there is provided an apparatus for wrapping a load with a web comprising: means for dispensing the web including means for rotatably supporting a roll of said web, and a series of rollers on shafts defining a web path through the dispensing means; means for rotating the load relative to the dispensing means to wrap the web on the load; leader line means for attachment to the leading end of the web and for drawing the web through the web path; and leader path means on one side of the series of rollers and generally parallel to but beside the web path for supporting the leader line means and confining the lateral movement of the leader line means while permitting longitudinal movement of the leader line means in the leading end of the web generally parallel to but beside the web path. It is preferable that the apparatus include means for driving at least two of the series of rollers at different relative surface speeds while wrapping the load so that the web is stretched between the rollers during wrapping.

Figure 4:
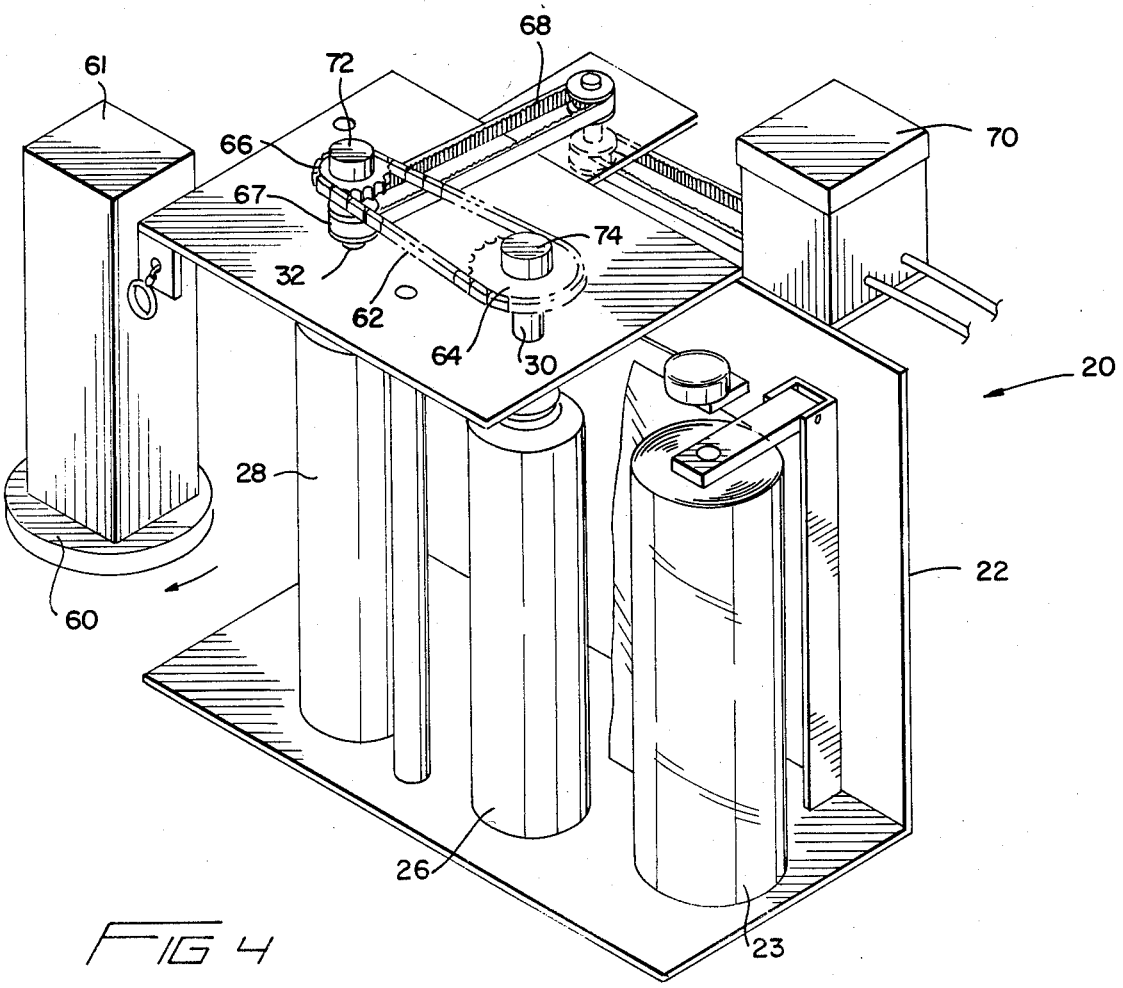
FIG. 4 is a front perspective view of the arrangement shown in FIG. 1.

As shown and embodied in FIG. 4, the apparatus for wrapping a load with a web comprises a stretch wrapping device 20 as shown and described above in relation to FIG. 1. Similarly, the dispensing means includes stretch wrapping dispenser frame 22 for supporting a roll 23 of film web 24, and prestretch rollers 26 and 28 as shown and described above in relation to FIG. 1. The means for rotating the load relative to the dispenser means includes a motor-driven turntable 60 for supporting and rotating a load 61 in a conventional manner. The leader line means and the leader path means are embodied as those shown and described above in relation to FIG. 1.

According to the present invention, there are preferably means for driving at least two of the series of rollers at different relative speeds during operation for stretching the web prior to dispensing the web from the dispensing means. As shown and embodied in FIG. 4, the driving means includes sprockets 64 and 66 mounted on shafts 30 and 32 of prestretch rollers 26 and 28. Sprockets 64 and 66 are connected by chain 62. Sprocket 64 is larger than sprocket 66 so that prestretch roller 28 is driven at a higher surface speed than prestretch roller 26 to stretch the film web 24. In addition, a belt 68 is connected from a pulley 67 or sprocket 66 to a torque controlled motor 70 for providing a constant torque assist to prestretch rollers 26 and 28.

The invention preferably includes means for selectively disengaging at least one of said at least two rollers from said driving means to reduce the force required to draw the web through the web path with the leader line means. As embodied and shown in FIG. 4, the selective disengagement means includes clutches 72 and 74 which selectively disengage sprocket 64 and 66 from shafts 30 and 32 during the web threading operation to reduce the force required to draw the web through the web path with leader cord 42.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents. For example, the web and leader paths may take other shapes, such as those shown in FIG. 3. The leader cord 42 can be driven by a motor rather than pulled by hand and can be in the shape of an endless loop rather than a retractable cord having two ends.

What is claimed is:

1. A method for threading the leading end of a web through a web path between a series of rollers on shafts in a stretch wrap web dispenser having means for driving at least two of the rollers at different relative speeds for prestretching the web between said at least two of the rollers while wrapping the load, comprising:

attaching the leading end of the web to a leader line which is located along a leader path on one side of the series of rollers, the leader path having portions generally parallel to but beside the web path;

maintaining the leader line in a retracted position in a leader line retractor during attahcment to the leading end of the web;

disabling the driving means to prevent said at least two of the rollers from being driven at substantially different relative speeds, to prevent the web from being substantially prestretched while being threaded through the web path and to reduce the force required to draw the web through the web path with the leader line means;

manually drawing the leader line and the leading end of the web through the leader path while drawing a section of the web which follows the leading end of the web through the web path between the series of rollers without substantially prestretching the web, simultaneously storing energy in the leader line retracter;

disengaging the leading end of the web from the leader line;

withdrawing the leader line to the retracted position in the retractor by using the stored energy in the retractor; and enabling the driving means to allow the web to be prestretched in the web dispenser while stretch wrapping a load.

2. An apparatus for threading the leading end of a web through a web path between a series of rollers on shafts in a stretch wrap web dispenser and for wrapping a load with the web comprising:

means for dispensing the web including means for rotatably suporting a roll of said web and a series of rollers on shafts defining a web path through the stretch wrap dispenser;

means for rotating the load relative to the stretch wrap dispenser to wrap the web on the load;

means for driving at least two of the rollers at different relative speeds for prestretching the web between said at least two of the rollers while wrapping the load;

leader line means for attahcment to the leading end of the web and for drawing the web through the web path between the series of rollers without prestretching the web; and retractor means for maintaining said leader line means in a retracted position during attachment to the leading end of said web, for allowing said leader line means to be withdrawn to an extended position from the retractor means when the web is drawn through the web path, for storing energy when the leader line means is withdrawn from the retractor means, and for using the stored energy to retract the leader line means to the retracted position after the web is drawn through the web path;

leader path means on one side of the series of rollers, said leader path means having portions generally parallel to but beside the web path for supporting the leader line means and generally confining the lateral movement of the leader line means while permitting longitudinal movement of the leader line means and the leading end of the web in a direction generally parallel to but beside of the web path; and means for selectively disabling the driving means for preventing said at least two of the rollers from being driven at substantially different relative speeds to prevent the web from being substantially prestretched while being threaded through the web path and to reduce the force required to draw the web through the web path with the leader line means, and for selectively enabling the driving means to allow the web to be prestretched in the stretch wrap dispenser while stretch wrapping a load.

3. The device of claim 2 wherein the leader path means includes at least one pulley mounted on the shaft of at least one respective roller.

4. The device of claim 3 wherein said at least one pulley is mounted to freely rotate relative to the respective roller.

5. The device of claim 3 whether said at least one pulley includes an indented outer surface for confining the lateral movement of the leader line means.

6. The device of claim 2 wherein the leader line means includes a proximal end portion by which the leader line means is engaged and drawn, a distal end portion, and means intermediate the proximal and distal end portions for said attachment of the leader line means to the web.

7. The device of claim 6 wherein the length of the distal portion is about at least as long as the length of the leader path means.

8. The device of claim 7 including retractor means attached to the distal portion for retracting the leader line means after the web has been threaded through the web path.

9. The device of claim 6 wherein said attachment means includes a loop.

10. The device of claim 9 wherein the loop includes a segment of elastic material.

11. The apparatus of claim 2 wherein the means for disabling is a clutch.

12. An apparatus for threading the leading end of a web through a web path between a series of rollers on shafts in a stretch wrap web dispenser and for wrapping a load with the web comprising:

means for dispensing the web including means for rotatably supporting a roll of said web and a series of rollers on shafts defining a web path through the dispensing means;

means for rotating the load relative to the dispenser means to wrap the web on the load;

leader line means for attachment to the leading end of the web and for drawing the web through the web path;

retractor means for maintaining said leader line means in a retracted position during attachment to the leading end of said web, for allowing said leader line means to be withdrawn to an extended position from the retractor means when the web is drawn through the web path, for storing energy when the leader line means is withdrawn from the retractor means, and for using the stored energy to retract the leader line means to the retracted position after the web is drawn through the web path; and leader path means on one side of the series of rollers, said leader path means having portions generally parallel to but beside the web path for supporting the leading line means and generally confining the lateral movement of the leader line means while permitting longitudinal movement of the leader line means and the leading end of the web in a direction generally parallel to but beside of the web path.

13. The apparatus of claim 12 including means for driving at least two of the series of rollers at different relative speeds while wrapping the load so that the web is stretched between the rollers during wrapping.

14. The apparatus of claim 13 including means for selectively disengaging at least one of said at least two rollers from said driving means to reduce the force required to draw the web through the web path with the leader line means.

15. The apparatus of claim 14 wherein said selective disengagement means is a clutch.

16. The device of claim 12 wherein the leader path means includes at least one pulley mounted on the shaft of at least one respective roller.

17. The device of claim 16 wherein said at least one pulley is mounted to freely rotate relative to said at least one respective roller.

18. The device of claim 16 whether said at least one pulley includes an indented outer surface for confining the lateral movement of the leader line means.

19. The device of claim 12 wherein the leader line means includes a proximal end portion by which the leader line means is engaged and drawn, a distal end portion, and means intermediate the proximal and distal end portions for said attachment of the leader line means to the web.

20. The device of claim 19 wherein the length of the distal portion is about at least as long as the length of the leader path means.

21. The device of claim 19 wherein said attachment means includes a loop.

22. The device of claim 21 wherein the loop includes a segment of elastic material.

23. A method for threading the leading end of a web through a web path between a series of rollers on shafts in a stretch wrap web dispenser comprising:

attaching the leading end of the web to a leader line which is located along a leader path on one side of the series of rollers, the leader path having portions generally parallel to but beside the web path;

maintaining the leader line in a retracted position in a leader line retractor during attachment to the leading end of the web;

manually drawing the leader line and the leading end of the web through the leader path while drawing a section of the web which follows the leading end of the web through the web path, simultaneously storing energy in the leader line retractor;

disengaging the leading end of the web from the leader line; and withdrawing the leader line to the retracted position in the retractor by using the stored energy in the retractor.

* * * * *